US006918254B2

(12) United States Patent
Baker

(10) Patent No.: US 6,918,254 B2
(45) Date of Patent: Jul. 19, 2005

(54) SUPERHEATER CAPILLARY TWO-PHASE THERMODYNAMIC POWER CONVERSION CYCLE SYSTEM

(75) Inventor: Karl William Baker, Centreville, VA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 10/676,874

(22) Filed: Oct. 1, 2003

(65) Prior Publication Data

US 2005/0072153 A1 Apr. 7, 2005

(51) Int. Cl.[7] ..... F01K 7/34

(52) U.S. Cl. ..... 60/653; 60/651; 60/671; 60/676; 165/104.26

(58) Field of Search ..... 60/645, 651, 653, 60/670, 671, 676; 165/104.26

(56) References Cited

U.S. PATENT DOCUMENTS

| | | | | | |
|---|---|---|---|---|---|
| 3,370,573 | A | * | 2/1968 | Hanzalek et al. | 122/406.5 |
| 3,972,193 | A | * | 8/1976 | Stevens et al. | 60/653 |
| 4,186,559 | A | * | 2/1980 | Decker et al. | 60/670 |
| 4,240,257 | A | * | 12/1980 | Rakowsky et al. | 60/670 |
| 4,347,705 | A | * | 9/1982 | Mirante | 60/651 |
| 4,367,629 | A | * | 1/1983 | Cann | 60/669 |
| 4,546,758 | A | * | 10/1985 | Ebernard | 126/635 |
| 5,816,313 | A | * | 10/1998 | Baker | 165/104.26 |

* cited by examiner

*Primary Examiner*—Sheldon J Richter
(74) *Attorney, Agent, or Firm*—Derrick Michael Reid

(57) ABSTRACT

A two-phase thermodynamic power system includes a capillary device, vapor accumulator, superheater, an inline turbine, a condenser, a liquid pump and a liquid preheater for generating output power as a generator. The capillary device, such as a loop heat pipe or a capillary pumped loop, is coupled to a vapor accumulator, superheater, the inline turbine for generating output power for power generation, liquid pump and liquid preheater. The capillary device receives input heat that is used to change phase of liquid received from the liquid preheater, liquid pump and condenser into vapor for extra heating in the superheater used to then drive the turbine. The power system is well suited for space applications using a radioisotope, active nuclear or solar heat source. The system can use waste heat from various dynamic or static power systems as a heat source and waste heat from spacecraft components such as electronics as a heat source. These heat sources can be used separately or in any combination. The power system can be combined with thermal energy storage devices when operated with heat sources that are not steady state. Heat sources are useful for driving the capillary wick, superheater and liquid preheater for increased power efficiency and long lifetime operation. The power system is well suited for space receiving heat from a heat source to produce useful mechanical energy. A superheater in combination with a liquid pump and preheater are implemented for use with the evaporator for improved thermal efficiency while operating at maximum cycle temperatures well below other available power conversion cycles.

20 Claims, 2 Drawing Sheets

SUPERHEATER POWER GENERATING THERMAL CYCLE SYSTEM

SUPERHEATER POWER GENERATING THERMAL CYCLE SYSTEM

SUPERHEATER POWER GENERATING THERMAL CYCLE

SUPERHEATER CAPILLARY TWO-PHASE THERMODYNAMIC POWER CONVERSION CYCLE SYSTEM

REFERENCE TO RELATED APPLICATION

The present application is related to applicant's application entitled Capillary Two-Phase Thermodynamic Power Conversion Cycle System Ser. No. 10/431,826, filed May 8, 2003, now U.S. Pat. No. 6,857,269, issued Feb. 22, 2003, by the same inventor, here incorporated by reference as there fully set forth.

STATEMENT OF GOVERNMENT INTEREST

The invention was made with Government support under contract No. F04701-00-C-0009 by the Department of the Air Force. The Government has certain rights in the invention.

FIELD OF THE INVENTION

The invention relates to the field of thermodynamic power systems. More particularly, the present invention relates to two-phase thermal cycle systems, capillary devices, power generators, thermal condensers and liquid pumps.

BACKGROUND OF THE INVENTION

Thermodynamic power cycle systems have typically been used to generate useful work, such as in power generation systems. Thermodynamic power cycles have typically been used to turn heat input into the system into useful work as for power generation. Radioisotope elements, active nuclear and solar are used as heat sources for space power systems. Thermoelectric power conversion systems are currently used in deep space missions while photovotaics are used for earth orbiting and some planetary missions. Radioisotope thermoelectric generators have thermodynamic efficiencies of seven to four percent or less while photovotaics have overall efficiencies of typically 16% at end of life.

It is desirable to increase the efficiencies and power conversion levels of space based power generators. It is also desirable to directly produce AC power and thus eliminate the need for power converters for certain applications. It is also desirable to achieve high efficiencies and power conversion levels while the power conversion system operates at a lower maximum temperature relative to other power conversion systems. It is also desirable to have a power cycle that accepts heat input at different temperature levels. These different heat input temperatures allow for the recovery of waste heat used as heat input. It is also advantageous to have a power conversion system that is capable of storing energy using thermal energy storage media that is more efficient than batteries. It is also desirable to have a power system capable of operating as a bottoming cycle in a space-based cogeneration power system. Space power systems that do not generate AC power disadvantageously may require the use of an additional power converter, such as in photovoltaic and thermoelectric systems. Turbines have been used both terrestrially and in space to generate AC power. Space based dynamic power conversion cycles have been limited to single-phase Brayton and Stirling systems. The overall thermodynamic efficiency of two-phase power conversion systems, such as the Rankine system, is generally greater than single-phase systems. Large terrestrial two-phase Rankine cycle systems typically operate at over thirty percent efficiency. Although the Rankine cycle has been used extensively in terrestrial applications for power generation, the Rankine power cycle has not been used in space applications because of the difficulty and complexity required to manage a two-phase power system fluid in micro gravity.

Rankine cycle systems are typically described using conventional temperature and entropy graphs and functional block descriptions. A typical Rankine system includes an input heat source, a boiler, a superheater, a turbine, a condenser, and a liquid pump. Heat is input into the boiler, the working fluid gradually changes from liquid to vapor as heat is received. That is, the Rankine cycle entropy extends from a subcooled liquid point to a saturated vapor point during heat addition. The heating in the boiler of a Rankine cycle system provides the working fluid flow with an infinitesimally small amount of heat input, which results in an infinitesimally small change in the quality of the flow. In the boiler of a Rankine cycle system, the vapor and liquid are carried together. The boiler provides a phase change from liquid to vapor. The input heat source heats the working fluid in the boiler generating and providing saturated vapor, which is fed into the superheater. The superheated vapor then spins the turbine for providing output work, such as electrical power. The superheater is used to ensure that the vapor entering the turbine is superheated to a higher pressure and thus has no liquid droplets in it to avoid liquid impingement with the turbine blades while providing sufficient pressure and flow to spin the turbine to generate the desired amounts of power. The turbine provides low-pressure saturated vapor to the condenser. The condenser provides a phase change from vapor to liquid. The liquid is then pumped by the active pump into the boiler for completing the cycle. The Rankine cycle disadvantageously requires all input heat to be transferred to the work fluid while at one pressure. Having the working fluid at constant pressure during the heat addition process restricts the cycle and limits the amount of low temperature heat that can be added. Rankine cycle also disadvantageously uses a boiler to add heat to the cycle flow. For terrestrial applications, gravity is used to maintain the separation of liquid and vapor in the boiler and at the active liquid pump. Maintaining this separation without gravity, in space, is difficult and typically makes Rankine power cycle systems unsuitable for space applications.

Commercial loop heat pipes and capillary pumped loops have been developed to passively control the dynamics and location of liquid and vapor interface points in micro gravity. As such, loop heat pipes and capillary pumped loops are commonly used for the thermal control of spacecraft. To date, there are over one hundred loop heat pipes and capillary pumped loops in operation, on orbit, on spacecraft. The loop heat pipe as well as the capillary pumped loop allows deployable condensers to be used on spacecraft as part of a two-phase heat rejection system. A loop heat pipe or capillary pumped loop includes a capillary wick that facilitates flow from a low pressure point to a high pressure point. The capillary wick is used to pressurize and drive the loop heat pipe or capillary pumped loop heat rejection system. Loop heat pipes and capillary pumped loops have pumping capabilities orders of magnitude greater than simple heat pipes. Loop heat pipes are being used on commercial satellites and are described in U.S. Pat. No. 5,743,325. The transport lines of the loop heat pipe or a capillary pumped loop heat rejection system are typically made from simple tubing that is bent and welded. Loop heat pipe and capillary pumped loop systems use Aluminum, stainless steel and other nickel based superalloys for use typically with ammonia as the working fluid. Deployable condensers and flexible tubing are used to configure the heat rejection system.

A capillary wick receives a saturated liquid. The liquid wets the capillary wick. It is drawn through the capillary wick because the working fluid molecules are attracted more to the capillary wick material than they are to each other. The liquid is also pushed through the capillary wick through pressurization. The capillary wick provides the separation between the high-pressure vapor and the low-pressure liquid. Heat is input on the high-pressure side of the capillary wick where the fluid is vaporized. Once liquid turns into vapor through evaporation, the volume of the working fluid increases orders of magnitude causing the pressure to increase on the high-pressure side of the capillary wick. This increase in pressure pushes the saturated vapor forward through the system. The flow cannot go backwards toward the lower pressure saturated liquid path because the pores in the capillary wick are so small that a meniscus forms in them and acts as a barrier to the high-pressure vapor. Capillary wicks with pores sizes of about one micron are commercially available. Based on the Laplace-Young equation, which is a function of pore geometry and surface tension, and wetting angle and using ammonia as a working fluid, a capillary wick with one-micron pores can sustain a pressure differential of approximately ten psi.

The loop heat pipe is similar to a capillary pumped loop, but having different placement of the fluid reservoir. In the loop heat pipe, the reservoir is attached to the evaporator. In the capillary pumped loop, the reservoir is remotely located with respect to the evaporator. A loop heat pip or capillary pumped loop generates fluid pumping energy through the addition of heat, from an input heat source, onto a capillary wick.

Two-phase power systems are the most efficient types of power systems. The two-phase liquid vapor interface management problem is solved for loop heat pipe and capillary pumped loop thermal control capillary devices. Although two-phase systems have been used extensively on earth, two-phase power systems have not been used in space because of an inability for controlling the interface between the two-phases in micro gravity during steady state operation as well as transient operation. These and other disadvantages are solved or reduced using the invention.

SUMMARY OF THE INVENTION

An object of the invention is to provide a two-phase thermal cycle for use as a thermodynamic power system pressurized by a capillary device, superheater and liquid pump.

Another object of the invention is to provide a two-phase thermal cycle for use in a thermodynamic power system pressurized by a capillary device, superheater and liquid pump for driving a turbine for providing output energy.

Yet, another object of the invention is to provide a two-phase thermal cycle for use in a thermodynamic power system pressurized by a capillary device, superheater and liquid pump for generating power during power generation.

Yet, another object of the invention is to provide a two-phase thermal cycle for use in a thermodynamic power system pressurized by a capillary device, superheater and liquid pump for generating power at high efficiencies while operating at low temperatures.

Yet, another object of the invention is to provide a two-phase thermal cycle for use in a thermodynamic power system pressurized by a capillary device, superheater and liquid pump for generating power using heat input at varying pressures and temperatures.

Yet another object of the invention is to provide a two-phase thermal cycle for use in a thermodynamic power system pressurized by a capillary device, superheater and liquid pump for generating power using low grade or waste heat for recovery as part of the total heat input.

Yet another object of the invention is to provide a two-phase thermal cycle for use in a thermodynamic power system pressurized by a capillary device, superheater and liquid pump for generating power from a nonsteady heat source operating using stored thermal energy.

Yet another object of the invention is to provide a two-phase thermal cycle for use in a thermodynamic power system pressurized by a capillary device, superheater and liquid pump for generating power as a bottoming cycle in a cogeneration power system.

A further object of the invention is to provide a two-phase thermal cycle for use in a thermodynamic power system pressurized by a capillary device, such as a loop heat pipe, superheater and liquid pump.

Yet, a further object of the invention is to provide a two-phase thermal cycle for use in a thermodynamic power system pressurized by a capillary device, such as a capillary pumped loop, superheater and liquid pump.

Another object of the invention is to provide a two-phase thermal cycle for us in a thermodynamic power system pressurized by a capillary device providing an instantaneous transition from liquid to vapor phase of the working fluid using input heat.

Still a further object of the invention is to provide a two-phase thermal cycle for use in a thermodynamic power system pressurized by a capillary device for generating power during power generation with improved efficiency using an in-line superheater, a preheater, and a liquid pump.

The system is directed to a two-phase thermodynamic power cycle system that converts heat energy to work particularly useful in space power systems. The system uses a capillary wick of a capillary device that uses input heat to generate high-pressure saturated vapor. The high-pressure saturated vapor is kept separate from low-pressure saturated liquid. This capillary wick facilitates the flow transition from high pressure, high temperature, saturated liquid to high-pressure, saturated vapor, instantaneously, providing effective separation between liquid and vapor and being a passive pump. The system solves the problem of two-phase fluid management in micro gravity by simplifying the two-phase thermodynamic cycle system using a capillary device, such as loop heat pipe or a capillary pumped loop, for two-phase fluid control. The system is a power conversion unit that receives heat from a heat source to passively drive the capillary action. The capillary action passively separates liquid from vapor and pressurizes the flow so that high-pressure saturated vapor can enter the superheater of the system. Saturated high-pressure vapor flows into the superheater through diode valves. These valves allow the flow to enter the superheater but prevent the flow from flowing back towards the evaporator. Once the pressure in the superheater equals the pressure of the high pressure, saturated vapor, flow into the superheater stops. Heat addition to the high-pressure, saturated vapor continues until the vapor reaches the desired superheated vapor state. Once the vapor reached the desired state of superheat, the superheater control valve is opened releasing superheated vapor that flows to the turbine. Vapor flows isentropically through the turbine where work is taken out of the flow. Multiple superheater stages can be used. The pulsing of these multiple stages can be staggered in order to obtain a flow that is steadier than simple pulses. The superheater can be one leg or several parallel tube legs, for example each leg tens of feet long, bent in a serpentine manner, attached to a heat source. Each leg of the superheater has a controllable diode input valve and controllable exit valve. The flow exits the turbine as low-pressure, saturated vapor and enters the condenser. The vapor condenses in the condenser and leaves as low pressure saturated liquid. The condenser can be one tube, for example, tens of feet long, bent in a serpentine manner, and attached to a condenser panel. The condenser tubing can also be fabricated in a conventional parallel arrangement. Liquid enters a pump where work is put in and the liquid is pressurized isentropically to a high pressure, low temperature, subcooled liquid. The high pressure, low temperature, subcooled liquid flows through the liquid preheater and leaves as a high pressure, high temperature, saturated liquid which enters the evaporator to repeat the cycle. The liquid preheater can be one tube, for example, tens of feet long, bent in a serpentine manner, and attached to a heat source. The preheater tubing can also be fabricated in a conventional parallel arrangement.

The system preferably includes an evaporator comprising a capillary device having a capillary wick for receiving input heat and providing a phase change, a vapor accumulator to dampen and prevent mass flow oscillations from effecting the operation of the evaporator, a superheater receiving input heat and providing further increased pressure and temperature to the high pressure saturated vapor, a turbine for providing power, a condenser for radiating heat, a liquid pump for increasing the pressure of the low pressure saturated liquid and a preheater for increasing the temperature of the high pressure, low temperature, subcooled liquid.

The loop heat pipe or capillary pumped loop, collectively referred to as capillary devices, are preferably used in combination with a vapor accumulator, superheater, turbine, liquid pump and liquid preheater to produce output power. A turbine can be placed in the thermal cycle loop for providing output power during power generation. The system includes necessary tubing for transport of the working fluid between components, through the superheater, condenser, liquid pump and liquid preheater. The system can be used for small terrestrial solar, gas, heat recovery and/or geothermal as heat sources for power generation stations with an efficiency potentially higher than photovoltaic and basic Rankine systems. High grade AC power can be generated directly using a turbine-rotating machine to generate power.

The system preferably uses spacecraft thermal control technology, including loop heat pipes and capillary pumped loops, by combining these capillary devices with a turbine, superheater, liquid pump and liquid preheater. Loop heat pipes and capillary pumped loops are used for thermal control applications on spacecraft for a variety of reasons including that these devices allow for system integration with flexible lines, and enable deployable condensers. The system provides a two-phase dynamic power system suitable for space application. The system can be cost efficiently built as a system to generate power using the waste heat as a portion or all of the input heat from a spacecraft or waste heat from another dynamic or static power converters in a cascaded manner. This waste heat or cascaded system will yield a space power system with an overall efficiency of well over thirty percent to provide a spacecraft with significantly more power while enabling ion propulsion and increased payload capabilities.

The system obtains pressurization of high pressure, saturated vapor flow occurring at the capillary wick. In the thermal cycle of the system, high pressure saturated vapor and high pressure, high temperature saturated liquid points are separated during the capillary heat source input phase of the cycle. That is, the working fluid abruptly changes from a saturated high pressure, high temperature saturated liquid to high-pressure saturated vapor. During heat addition, high pressure, high temperature, saturated fluid changes directly to high pressure, saturated vapor and the quality of the flow goes directly from all liquid to all vapor. The thermal cycle process jumps from the high pressure, high temperature, saturated liquid point to high-pressure, saturated vapor point. This entropy jump on the temperature and entropy diagram mirrors the physics at the liquid vapor interface of the capillary wick, where high pressure high temperature saturated liquid is physically in contact, but separated from high pressure saturated vapor. When an infinitesimally small amount of heat is added at the saturated vapor side of the capillary wick, an infinitesimally small amount of high pressure, saturated vapor will be formed. At the vapor liquid interface of the thermal cycle, liquid and vapor are in contact but separated across the capillary wick. The capillary wick can be built using different types of materials and in different geometries. The evaporator of a loop heat pipe or capillary pumped loop contains a capillary wick. The loop heat pipe evaporator includes a primary capillary wick and a secondary wick, the reservoir, the liquid input line, and vapor exit line, as well as the housing for the primary capillary wick. The capillary wick receives heat from an input heat source. Conventional loop heat pipe or capillary pumped loop evaporators can be used.

The superheater is used to significantly increase the pressure of the vapor by adding additional heat bringing it to a superheated state. Although the vapor flow from the evaporator flows through the accumulator into the superheater, the evaporator is not exposed to the high pressures generated in the superheater. This is accomplished by pulsing the superheater using controllable diode and control valves. This allows for significantly higher-pressure, superheated vapor to flow into the turbine for power generation. This also insures that the working fluid flowing into the turbine is all vapor. In the preferred form of the invention, the superheater, disposed after the capillary wick and accumulator, is connected to a higher temperature heat source compared to the evaporator and liquid preheater heat sources. The superheater used in combination with a preheater and with a liquid pump that are both disposed before and the capillary wick allow for improved efficiency by increasing the operating range of the system. The flow is high-pressure saturated vapor that flows into the superheater. The superheater is preferably a heat exchanger that must interface with a heat source that is maintained at a higher temperature than the capillary wick. In practice, the superheater is a plurality of heat exchanging tubular chambers through which the cycle working fluid flows and is heated. Flow at the entrance to these chambers is checked by a diode valve, only allowing flow in. The exit to these chambers is checked by a control valve, operated so that the chamber pulses. This heat chamber can be attached to an external heat source. The flow is then heated for staggered release. Using multiple chambers, a quasi-continuous superheated vapor flow can be achieved for driving the turbine. The superheater is used to increase the efficiency of the cycle and to heat the working fluid to ensure that no condensed droplets enter the turbine. The impingement of droplets on the turbine will eventually cause the turbine to erode. The superheated vapor is passed through the turbine. Thermal energy storage material such as a phase change material can be connected to the superheater to store energy so that the superheater can operate constantly even if the heat source is not steady such as solar heating in Low Earth Orbit. This thermal energy storage material can be a single phase metal such as beryllium, or a two phase such as lithium or a molten salt that changes phase at the superheater operating temperature.

The superheater is used to increase power output of the device by adding heat into the flow. The liquid pump is used to increase the pressure of the condensed liquid so that the liquid returning to the evaporator is at a pressure close to that of the high-pressure saturated vapor. Using the superheater and liquid pump the pressure difference, from lowest pressure to highest pressure in the cycle can be increased without regard to the maximum sustainable pressure differential across the capillary wick. The capillary wick is isolated from these extreme pressures and is mainly required to separate liquid and vapor. A small pumping capability is required only to move the high-pressure saturated vapor through the vapor accumulator into the superheater. The liquid preheater is used to reduce the amount of evaporator input energy required. With a liquid pump incorporated into the power cycle, low operating temperatures, just above the freezing point of the working fluid, are possible in the condenser. After this low pressure, saturated fluid from the condenser passes through the liquid pump it is significantly subcooled. If this fluid were returned directly to the evaporator without passing through the liquid preheater, it would require that a significant amount of additional heat be added through the evaporator, beyond that required only for evaporation of the fluid. Because the geometry of the evaporator is restricted because of limitations with respect to the capillary structure and the desire to use LHP and CPL flight hardware, additional heat input to the evaporator will result in increased temperature gradients that will reduce the efficiency of the overall system and could cause operation problems. The preheater geometry can be designed to effectively accept a portion of the required input heat transforming the working fluid from a subcooled state to a saturated state allowing the evaporator to operate more efficiently. For an isotope or active nuclear space system, the preheater and superheater can interface with the same heat source that drives the capillary wick, however the superheater would receive higher temperature heat. For satellites, the liquid preheater and evaporator could be exposed to waste heat from the satellite electronics and the superheater could be heated by solar energy. Heat input to the superheater can be direct from a heat source or using thermal energy storage. For a space-based application, the turbine can have an electromagnetic coupling for eliminating leakage around shaft seals. The superheated vapor drops in pressure as energy is extracted. The flow will then enter the condenser where heat will be transferred out to an external sink in the environment. In practice, the condenser can be a tube that the cycle flow passes through with several serpentine bends. This tube is exposed to a cold heat sink. The cold heat sink will cause the vapor to condense to liquid as the flow is forced through the condenser tubes. The flow exits the condenser as saturated liquid to enter the liquid pump where the pressure is increased isentropically. High pressure, low temperature, subcooled liquid leaving the pump enters the liquid preheater where heat is added. The flow, high pressure, high temperature, saturated liquid leaves the liquid preheater and enters the capillary wick to repeat the cycle. The system provides two-phase thermodynamic operation well suited for space-based applications. These and other advantages will become more apparent from the following detailed description of the preferred embodiment.

DETAILED DESCRIPTION OF THE PREFERRED EMBODIMENT

Figure 1:
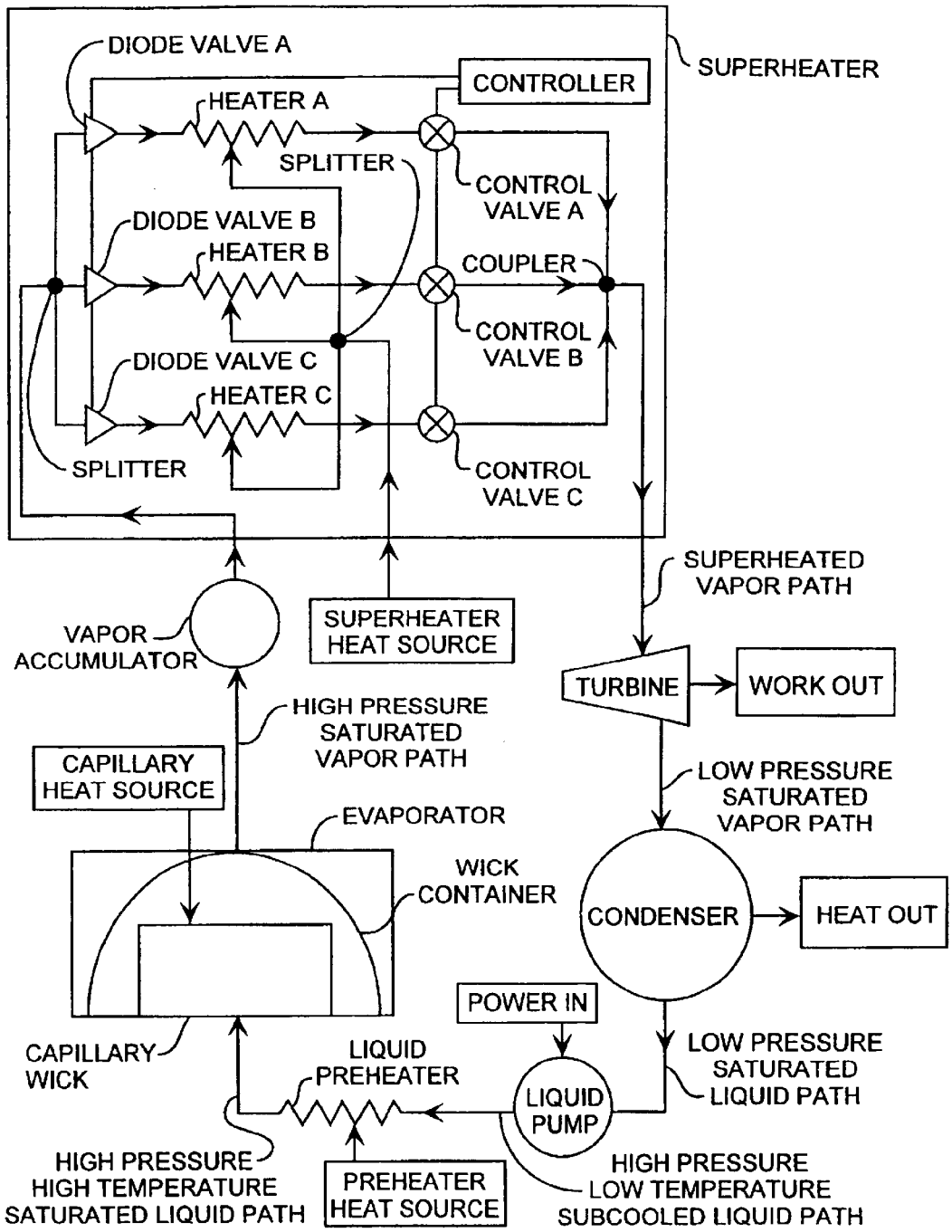
FIG. 1 is a block diagram of a superheater power generating thermal cycle system.

An embodiment of the invention is described with reference to the figures using reference designations as shown in the Figures. Referring to FIG. 1, a two-phase thermodynamic power system includes a capillary device, a superheater, an inline turbine, a condenser, a liquid pump and a liquid preheater for generating output power. The capillary device, such as a loop heat pipe or a capillary pumped loop, is coupled to an accumulator that is coupled to the superheater. The capillary device includes a capillary wick and a container, combined to make an evaporator. The capillary device is driven by a capillary heat source. The capillary device provides high-pressure saturated vapor through a high-pressure vapor path to a preferred vapor accumulator that is in turn connected to the superheater. The superheater includes a plurality of unidirectional diode valves, such as valves A, B, and C, that are respectively connected to a plurality of heating chambers, such as chambers A, B, and C, that are heated by a superheater heat source connected to a splitter for routing heat to the chambers. Each of the heating chambers are in turn respectively connected to control valves, such as control valves A, B, and C, that are controlled by a controller for staggered release of superheated vapor through a superheated vapor path to the inline turbine. The superheater is coupled to the inline turbine for generating output power as power out for operation as an electrical power generator. The low-pressure saturated vapor enters the superheater where it is superheated for driving the turbine. When passing through the turbine, the superheated vapor is cooled to low-pressure saturated pressure vapor that is passed into a low-pressure saturated vapor path connected to a condenser. Low pressure saturated vapor exiting the turbine condenses to liquid in the condenser into low-pressure saturated liquid and flows through a low-pressure saturated liquid path. This low-pressure saturated liquid may then be preferably pressurized while passing through a liquid pump providing high-pressure, low temperature subcooled liquid into a high-pressure, low temperature subcooled liquid path. The high-pressure, low-temperature, subcooled liquid is then heated in a liquid preheater provided high-pressure, high-temperature saturated liquid to the capillary device completing the cyclic path around the thermodynamic power system. The capillary device receives input heat from the capillary heat source and this heat is used to change the phase of the high-pressure, high-temperature liquid into high-pressure saturated vapor. The superheater isolates extremely high-pressure vapor from the capillary device. The optional liquid pump isolates extremely low pressure liquid from the capillary device isolating either or both high and low cycle pressures from the capillary device that allow the cycle to operate at differences in pressure far greater than that which the capillary device can sustain, for providing increased power output over the power that can be provided by only the capillary device.

The system relies on a pressure difference generated during the evaporation of the working fluid from a capillary wick to create a high-pressure saturated vapor that is then superheated for driving the turbine. Hence, the maximum power production is not limited by the maximum capillary pressure differential that can be sustained across the capillary wick. The superheater is coupled through the flow of the working fluid but decoupled with respect to pressure from the capillary wick using unidirectional vapor valves such as the diode valves. The capillary wick in the cycle provides the pressure difference generated across the wick structure that is only required to establish fluid flow through the accumulator and into the superheater, while separating liquid from vapor. High temperature heat energy input to the system preferably enters through the superheater while low-temperature heat energy input enters through the liquid preheater and evaporator.

In the superheater, the flow-pressure is significantly increased through heat addition. This heat addition creates a condition where the maximum pressure differential in the cycle is the highest pressure out of the superheater minus the lowest pressure of the low-pressure saturated liquid path. This maximum pressure differential is far greater than the pressure differential that the capillary wick can sustain. However, the capillary wick is not subjected to this maximum pressure differential because the capillary wick is isolated from the pressure in the superheater by the diode valves. That is, the efficiency and power production of the system is not limited to only the pressure differential that the capillary device can sustain. High-pressures generated in the superheater do not affect the pressure in the high-pressure saturated vapor path of the cycle because pressures in the superheater are isolated from the saturated vapor path by diode valves. Under heat addition, the pressure in the superheater increases to a pressure level much higher than that in the high-pressure saturated vapor line. Flow from the superheater is isolated by the use of the diode valve on the saturated vapor side and is released by the use of the control valves. When the pressure in the pulse oscillating superheater reaches a predetermined valve, the control valve is opened exposing the high-pressure superheated vapor to the superheated vapor path that leads to the turbine. The high-pressure superheated vapor travels through the superheated vapor path to a turbine where power can then be efficiently extracted. The flow from the turbine enters the condenser, such as a radiator, where the low-pressure saturated vapor condenses into liquid. The unidirectional flow around the system is maintained but operating with significantly increased pressure ranges, temperature ranges, and power levels with improved efficiencies over simple capillary pumped devices. The liquid pump and liquid preheater are preferably added to further increase the operating range and efficiency of the system.

A working fluid, such as ammonia or water obtains a liquid phase and a vapor phase in the two-phase power generation system. Starting at the saturated liquid path, high-pressure, high-temperature saturated liquid moving along a high-pressure, high-temperature saturated liquid path to the evaporator being a capillary device having a capillary wick within a wick container. The evaporator may be, for example, an evaporator from a conventional loop heat pipe or a conventional capillary pumped loop. Forced heat into the evaporator serves to drive the capillary device. This high-pressure, high-temperature, saturated liquid is pushed into the capillary wick under pressure. The capillary wick provides the separation between the high-pressure saturated vapor and the high-pressure, high-temperature saturated liquid. Flow through the capillary wick is achieved because the working liquid wets the capillary wick as fluid molecules are attracted to the capillary wick more than to each other to draw the working fluid through the capillary wick. The fluid is also pushed through the capillary wick from the pressure generated at the saturated vapor side of the capillary wick, in the superheater and from the liquid pump. Heat from the capillary heat source is fed into the capillary wick that is further connected to the capillary evaporator that is in turn connected to a high-pressure saturated vapor path in which the working fluid is a saturated vapor. Vaporization increases the volume and pressure of the working fluid on the heated output side of the capillary wick. The vapor pressure pushes the working fluid as high-pressure saturated vapor forward through the high-pressure saturated vapor path towards the vapor accumulator and superheater. Flow backwards toward the saturated liquid path is blocked because the pores in the capillary wick are so small that the working fluid forms a meniscus in the capillaries. The meniscus serves as a barrier to the high-pressure saturated vapor. The pressure differential on opposing sides of the capillary wick is used to provide flow through the accumulator to the superheater.

The high-pressure saturated vapor path flow is connected to a superheater. The high-pressure saturated vapor is heated by the superheater connected to a superheated vapor path that connects to a turbine to produce power as work out. The vapor flows from the superheater through the turbine, extracting work and simultaneously lowering the pressure of the working fluid flow that reaches the low-pressure saturated vapor point. The superheater is a heat exchanger that may interface with the capillary heat source and preheater heat source in any combination or all heat sources can be separate. Heat sources can be radioisotope, active nuclear, and or solar. The heat source for the capillary device and liquid preheater is at a lower temperature than the heat source for the superheater. The heat source can include a thermal energy storage material such as a salt or liquid metal that having a single phase or multiple phases for providing heat during time of solar shade as when in a low earth orbit, while the superheater heat source is also a solar heat source for providing heat during times of solar illumination. The heat source for the capillary device and liquid preheater can be waste heat from a spacecraft or waste heat rejected from another power system. The superheater is preferably tubes with respective input diode valves and output control valves. The working fluid flows through the diode valves, into tubes that may have several serpentine bends, and then through the control valves in an oscillating manner having staggered releases of superheated vapor. The working fluid flow exits the superheater as a superheated vapor. The superheated vapor flows through the superheated vapor flow path. The superheater adds heat to the working fluid that ensures that no condensed liquid droplets enter the turbine. Superheated vapor can prevent erosion of the turbine. The superheated vapor path provides superheated vapor to drive the turbine. The superheated vapor flow drops in pressure as it flows through the turbine where energy is extracted in the form of mechanical energy, through a shaft, not shown. This mechanical energy can be used to perform useful work such as work out for turning a generator to generate electrical power. The low-pressure saturated vapor flow path is connected to the low-pressure side of the turbine. The working fluid can be nearly at saturation, slightly superheated or at a quality of typically above 90% as it flows through the low-pressure saturated vapor path out of the turbine. The low-pressure saturated vapor path is connected to the condenser. The working fluid flow will then enter the condenser from the low-pressure saturated vapor path. In the condenser, the working fluid will change phase, from a low-pressure vapor to a low-pressure liquid. Heat will be transferred out to an external sink, such as a radiator, in the environment as heat out. As the working fluid flow passes through the condenser, the working fluid undergoes a phase change from vapor to liquid. The condenser can be a tube through which working fluid flow passes using several serpentine bends. This tube is exposed to a cold heat sink, such as outer space. The exit of the condenser is connected to the low-pressure saturated liquid path. The working fluid flows from the condenser through the low-pressure saturated liquid path to an optional liquid pump. The liquid pump increases the pressure of the flow. The flow exits the pump through the high-pressure and low-temperature liquid path. The flow then enters an optional liquid preheater. The liquid pump and liquid preheater can be used to extend the performance envelop of the power cycle. This allows for a broad choice of operating fluids, power levels and boundary condition temperatures. The liquid preheater adds heat to the flow to increase the liquid temperature. The preheater can provide heat from the same heat source as the superheater heat source or the capillary heat source or the preheater can be heated from an independent heat source. The flow then enters the high-pressure and high-temperature saturated liquid path that is connected to the capillary wick. The cycle is repeated as the working fluid passes through the system for power generation.

Figure 2:
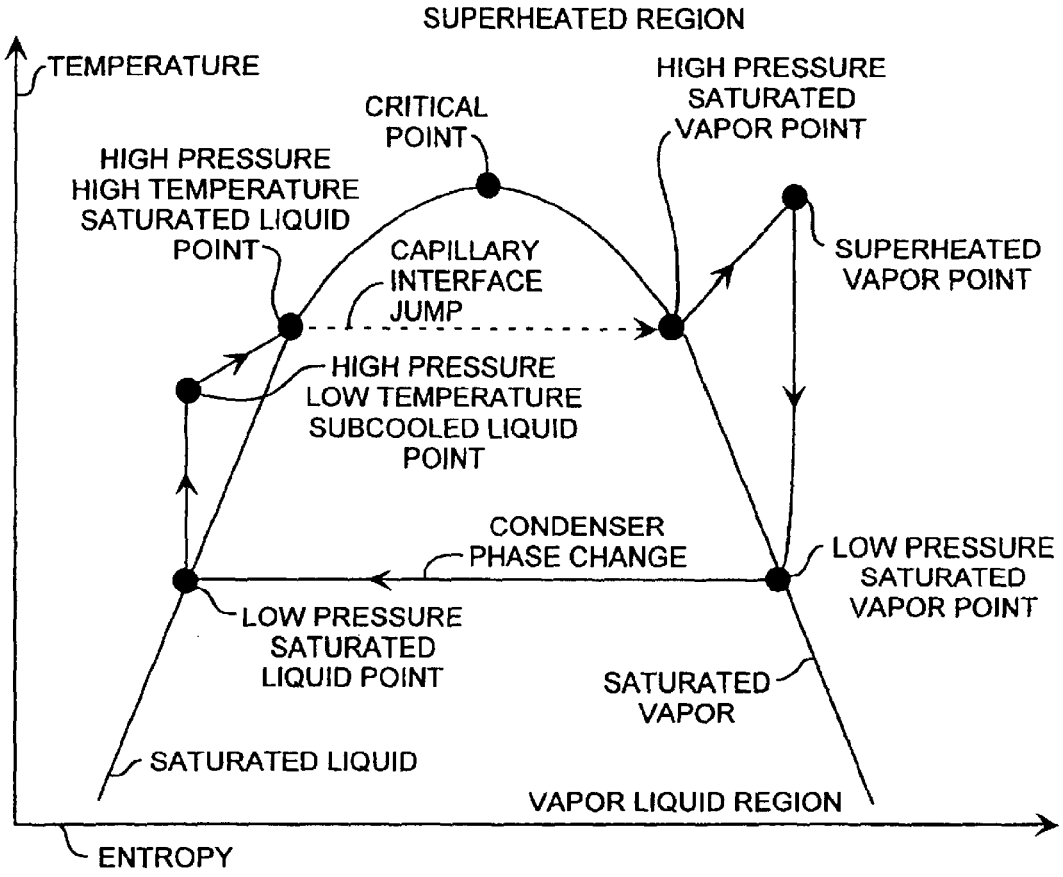
FIG. 2 is a temperature and entropy graph of a superheater power generating thermal cycle.

Referring to the Figures, and particularly to FIG. 2, the thermocycle can also be described with respect to fluid entropy. The working fluid preferably enters the capillary wick at a high-pressure high-temperature saturated liquid point. The liquid at the high-pressure high-temperature saturated liquid point and the vapor at the high-pressure saturated vapor point are completely separated during the heat addition to the capillary wick. During heat addition, saturated liquid changes directly to saturated vapor crossing the capillary interface jump. Crossing the capillary interface causes the working fluid to go directly from a saturated liquid to a saturated vapor without a mixture of vapor and liquid occurring during the heat addition process. That is, the capillary interface jump on the temperature and entropy graph of FIG. 2 mirrors the physics at the liquid vapor interface of the capillary wick, where lower-pressure liquid is physically in contact but separated from higher-pressure vapor. That is, at the vapor-liquid interface the liquid and vapor are in contact but separated. After heat addition, the working fluid is at the high-pressure saturated vapor point. The vapor is accumulated by the vapor accumulator, during operation the accumulator dampens pressure oscillations to the evaporator occurring from flow entering the superheater in pulses. As flow leaves the high pressure saturated vapor line and enters the superheater, flowing through the diode valves, pressure in the high-pressure saturated vapor line will momentarily drop. If this pressure drop is large enough, it could affect the operation of the evaporator. The accumulator effectively increases the overall volume of the high pressure saturated vapor available to the superheater and can be sized so that pressure oscillations are minimized. The accumulated high-pressure saturated vapor from the vapor accumulator flows into the superheater for superheating to a superheated vapor point. The superheated vapor at the superheated vapor point is passed through the turbine that cools the superheated vapor to low-pressure saturated vapor at the low-pressure saturated vapor point. The low-pressure saturated vapor is pass d through the condenser that changes the phase by a condenser phase change of the working fluid to a low-pressure saturated liquid at the low-pressure saturated liquid point. The low-pressure saturated liquid is pressurized to a subcooled state by the liquid pump and becomes a high-pressure low-temperature subcooled liquid at a high-pressure low-temperature subcooled liquid point. The high-pressure subcooled liquid is then heated by the preheater changing the flow into the high-pressure high-temperature saturated liquid at the high-pressure high-temperature saturated liquid point where the working fluid enters the capillary wick, to complete the entropy cycle.

Referring to Figures, and particularly to the superheater, the superheater is divided into parallel stages each having a respective diode valve, chamber, and control valve. The superheater can have as many stages as desired. For simplicity, a two-stage superheater is described having chambers A and B. Both chambers A and B are subjected to continuous steady state heat input from the superheater heat source. At time equal to zero, that is, T=0, the pressure in the superheater stage A is low at $P_{low}$, the pressure in the superheater stage B is high at $P_{high}$. At time T=0, the high-pressure saturated vapor flows into chamber A and the control valve A is closed. The control valve B for chamber B is then opened. When opened, high-pressure superheated vapor is injected by pressure into the superheated vapor flow path toward the turbine. At time equal to one, that is, T=1, the pressure of chamber A reaches a pressure equal to the pressure of the high pressure saturated vapor line pressure $P_{equal}$. At time T=1 flow into chamber A stops, as the control valve B for chamber B closes, and the pressure in chamber B is now at $P_{low}$, and the saturated vapor flow begins to enter chamber B. At time T=2, chamber A reaches the high-pressure $P_{high}$, and the control valve A is opened exposing high-pressure superheated vapor to the superheated vapor path toward the turbine. Flow again travels through the superheated vapor path toward the turbine. When the pressure in chamber B reaches $P_{equal}$ where superheated vapor flow in stops and the control valve B remains closed. At time three T=3, the two chambers A and B reach the same pressure as at time T=0, to complete the staggered pulsed cycling of the superheater. It should now be apparent that the flow from the superheater is staggered in pulse from the plurality of the chambers. It should further be apparent that other types of multiple stage superheaters could be used, such as inline superheaters using cascaded chambers operating in incremental predetermined temperature valves, but still having pulsed injection of incremental amounts of superheated vapor toward the turbine.

The high-pressure saturated vapor path from the capillary device is preferably connected to the vapor accumulator. Saturated vapor flows out of the vapor accumulator to the superheater. The vapor accumulator is an empty pressure vessel so that vapor can enter the superheater in mass flow pulses. The function of the vapor accumulator is to isolate the capillary evaporator from vapor mass flow pulses caused by the vapor flow stopping and starting at the superheater entrance of the unidirectional diode valves. These mass flow pulses could have an adverse effect on the ability of the capillary evaporator to maintain separation of vapor and liquid. These pulses could also cause a reduction in the temperature of the saturated vapor exiting the capillary evaporator. The volume of the vapor accumulator is such that vapor mass flow pulses induced at the superheater entrance will be dampened a sufficient amount so that there will be no adverse effect from these pulses on the capillary evaporator.

The saturated low-pressure liquid path is connected to a liquid pump. Liquid flows out of the liquid pump through the subcooled high-pressure low-temperature liquid path. The liquid pump can be a conventional terrestrial two-phase power cycle pump and be capable of increasing the pressure of the liquid by several hundred pounds per square inch. The liquid pump requires electric power input. A liquid pump in cycle is operated to increase the pressure of the working fluid liquid prior to entering the capillary evaporator. By increasing the pressure before entering the capillary evaporator, the pressure difference between the saturated high-pressure high-temperature liquid entering the evaporator and the high-pressure saturated vapor leaving the evaporator can be minimized while the saturated low-pressure liquid pressure in the condenser is chosen for optimum cycle efficiency. Using a liquid pump allows for increased cycle efficiency by enabling a lower operating temperature in the condenser.

The liquid preheater is connected to the subcooled high-pressure low-temperature subcooled liquid path from the liquid pump. Liquid flows out of the liquid preheater into the saturated high-pressure high-temperature saturated liquid path towards the capillary wick. The liquid preheater can be a hollow tube that interfaces with a preheater heat source to allow for heat addition. The preheater heat source is attached to the liquid preheater tube. The heat source can be waste heat from a spacecraft, solar energy, or nuclear energy. The heat source for the liquid preheater can be the same as or separate from the heat source for the capillary evaporator or the superheater.

With a liquid pump incorporated into the power cycle, low operating temperatures, just above the freezing point of the working fluid, are possible in the condenser. After this cold fluid from the condenser passes through the liquid pump, it is significantly subcooled. If this fluid were returned directly to the evaporator without passing through the liquid preheater, a significant amount of additional heat would need to be added through the evaporator, beyond that required only for evaporation of the fluid. This significant amount of added heat may adversely affect the performance of the capillary evaporator by requiring a significantly higher temperature for heat input to the evaporator. Adding the liquid preheater to the cycle allows for the liquid to be preheated prior to entering the evaporator which enables the evaporator to operate at high efficiency while the power cycle operates over an extended temperature range.

The thermodynamic power system is well suited for a variety of space applications such as a primary power system using a radioisotope, active nuclear, waste heat, and/or solar energy as a heat source. These heat sources are useful for heating the liquid preheater, the capillary wick and the pulse superheater and driving the working fluid flow for increased power efficiency and lifetime operation. The power system is well suited for space receiving heat from a heat source to produce useful mechanical energy. The two-phase thermodynamic power cycle provides improved efficiency of over 30% while operating at a maximum temperature of 637.4K. The system yields a power converter that is efficient while operating at relatively low maximum temperatures. Also, because the heat addition process occurs at varying temperatures, low-grade waste can be used to supplement the energy heat source requirements. Those skilled in the art can make enhancements, improvements, and modifications to the invention, and these enhancements, improvements, and modifications may nonetheless fall within the spirit and scope of the following claims.

What is claimed is:

1. A system for conducting a working fluid and for receiving input heat from a heat source and for providing work out, the system comprising, a capillary device for receiving the input heat from the heat source and phase changing and separating the working fluid from a liquid state to the first vapor state at a first vapor pressure, a superheater for receiving the input heat and heating the working fluid in the first vapor state to a second vapor state, the working fluid in the first vapor state is heated into the second vapor state at a second vapor pressure at a superheated temperature in staggered amounts, a turbine for converting thermal energy of the working fluid in the second vapor state into mechanical energy as the work out while converting the working fluid from the second vapor state to a third vapor state at the third vapor pressure, and a condenser for phase changing the working fluid in the third vapor state into a liquid state while rejecting waste heat.

2. The system of claim 1 wherein, the first vapor state is a saturated vapor state, the second vapor state is a superheated vapor state, and the third vapor state is a saturated vapor state.

3. The system of claim 1 wherein, the capillary device is a loop heat pipe.

4. The system of claim 1 wherein, the capillary device is a capillary pumped loop.

5. The system of claim 1 wherein, the system is a power generator, and the turbine converts energy by extracting thermal energy from the working fluid to produce output power as work out.

6. The system of claim 1 wherein, the first vapor state has a first vapor pressure and a first temperature, the second vapor state has a second vapor pressure and a second temperature, the third vapor state has a third vapor pressure at a third temperature, the first temperature is lower than the second temperature, the second temperature is higher than the third temperature, and the first vapor pressure is higher than the third vapor pressure.

7. The system of claim 1, wherein, heat is radiated from the condenser.

8. The system of claim 1 wherein the superheater comprises, stages respective comprising:

continuous control valves for receiving the working fluid from the capillary device;

heating chambers for superheating the staggered amounts of the working fluid; and control valves for ejecting the staggered amounts of the working fluid, wherein each of the control valves are activated at staggered times for ejected the staggered amounts of the working fluid at staggered times in pulses.

9. The system of claim 1 wherein the superheater comprises, stages respective comprising: continuous control valves for receiving the working fluid from the capillary device; heating chambers for superheating the staggered amounts of the working fluid; and control valves for ejecting the staggered amounts of the working fluid, wherein each of the control valves are activated at staggered times for ejected the staggered amounts of the working fluid at staggered times in pulses, and a controller for controlling the control valves for providing the ejection of the staggered amounts of the working fluid at staggered times in pulse, the controller for controlling the control valve when temperatures of the working fluid in the heating changer are at predetermined values.

10. The system of claim 1 further comprising, a vapor accumulator disposed between the capillary device and the superheater for continuously accumulating the working fluid from the capillary device and for dispensing the working fluid in incremental amounts respectively into the stages of the superheater for dampening pressure oscillations entering superheater.

11. The system of claim 1 further comprising, a liquid pump for pressurizing the working fluid in the liquid state, and a preheater for heating the working fluid in the liquid state.

12. The system of claim 1 wherein, the superheater heat source and the capillary heat source are the same heat source.

13. The system of claim 1 wherein, the superheater heat source and the capillary heat source and the preheater heat source are all separate heat sources where the heat source for the superheater is at a temperature higher than temperatures of the input heat from the capillary heat source and the preheater heat source.

14. The generator of claim 1 wherein, the superheater heat source is selected from the group consisting of a radioisotope heat source, an active nuclear heat source, a solar heat source, and a waste heat source.

15. The generator of claim 1 wherein, the capillary heat source is solar energy.

16. The generator of claim 1 wherein, the capillary heat source and preheater heat source receive heat dissipated from spacecraft electronics.

17. The generator of claim 1 wherein, the system is for powering a spacecraft, the superheater heat source and the capillary heat source are selected from the group consisting of a radioisotope power system, or spacecraft electronics or solar radiation, and the condenser radiates heat out for rejection of waste heat into outer space.

18. The generator of claim 1 wherein, the heat input to the superheater comprises a thermal energy storage material.

19. The system of claim 1 further comprising, a liquid pump for pressurizing the working fluid in the liquid state into a pressurized liquid state, the liquid pump being coupled to the condenser, and a preheater for heating the working fluid in the pressurized liquid state into a heated pressurized liquid state, the preheater being coupled to the capillary device.

20. The system of claim 19 wherein, the superheater heat source and the capillary heat source and the preheater heat source are the same heat source.

* * * * *